United States Patent [19]

Feldman et al.

[11] Patent Number: 4,985,800

[45] Date of Patent: Jan. 15, 1991

[54] LIGHTING PROTECTION APPARATUS FOR RF EQUIPMENT AND THE LIKE

[76] Inventors: Nathan W. Feldman, 910 Van Court Ave., Elberon, N.J. 07740; Malvin L. Shar, 74 Tinton Ave., Eatontown, N.J. 07724

[21] Appl. No.: 428,792

[22] Filed: Oct. 30, 1989

[51] Int. Cl.[5] ..... H01P 5/00

[52] U.S. Cl. ..... 361/113; 361/117; 333/12; 333/206

[58] Field of Search ..... 361/58, 113, 117, 126, 361/117–119; 333/12, 39, 33, 115, 124, 126, 260, 206

[56] References Cited

U.S. PATENT DOCUMENTS

| | | | |
|---|---|---|---|
| 2,196,272 | 4/1940 | Peterson | 333/206 |
| 3,289,117 | 11/1966 | Kearns et al. | 361/117 |
| 3,747,030 | 7/1973 | Walding | 333/206 |
| 4,399,419 | 8/1983 | Dobrovolny | 333/12 |
| 4,542,358 | 9/1985 | Boby | 361/118 |
| 4,554,608 | 11/1985 | Block | 361/119 |

*Primary Examiner*—Todd E. Beboer

*Attorney, Agent, or Firm*—Michael Zelenka; Robert A. Maikis

[57] ABSTRACT

Lightning protection apparatus for antenna-coupled RF equipment is provided. A one quarter wavelength shorting stub bandpass filter shunts the RF equipment and a distributed capacitance, high voltage coaxial capacitor is serially coupled between the equipment and antenna. The shorting stub is tuned to one quarter wavelength of the RF equipment operating frequency. The series capacitor passes frequencies at or above the operating frequency of the RF equipment.

3 Claims, 4 Drawing Sheets

LIGHTING PROTECTION APPARATUS FOR RF EQUIPMENT AND THE LIKE

STATEMENT OF GOVERNMENT RIGHTS

The invention described herein may be manufactured, used and licensed by or for the Government for governmental purposes without the payment of any royalties thereon.

BACKGROUND OF THE INVENTION

1. Field of the Invention

This invention relates to communications and other electronics systems which utilize antennas which are exposed to lightning and similar environmental disturbances and more particularly to lightning protection apparatus for such systems.

2. Description of the Prior Art

Receiving and transmitting antennas for radio and other RF equipment are often positioned as high as possible above the ground and are usually arranged to be above trees and other structures. Accordingly, they are very likely to attract lightning strokes or to be affected by near misses. When the antenna is struck by lightning or is even subject to a near miss, a surge of current of a very high order of magnitude is induced in the antenna and transmitted to the RF equipment to which the antenna is coupled. Needless to say, it is necessary to protect RF equipment from the high current and voltages to which they may be subjected by such atmospheric events.

Lightning usually consists of one or more pulses having a short rise time and a long decay time. The currents induced by lightning could range into the thousands of amperes. One known method of protecting against current and voltage surges is a series circuit breaker. This may take several forms, such as a fuse, an electromechanical circuit breaker or a self-triggering solid state circuit breaker, for example. Unfortunately, each of these devices has a relatively long operating time delay which may permit the equipment being protected to be damaged. Additionally, these devices disturb the operation of the equipment being protected by preventing operation of the equipment until the device is repaired or reset. Another method of protecting antenna coupled RF equipment is to employ a shunt or bypass device that would either disipate the energy of the lightning stroke or bypass it to ground. Many of these devices are also subject to the operating time delay and need to repair/reset ills to which the series circuit breaker devices are subject. A third method of protection is the tuned or selective type of protection system which will allow only the desired RF signals or "traffic" to flow to/from the antenna but will divert or bypass the harmful energy of the lightning occurrence. It is this method with which the present invention is concerned.

SUMMARY OF THE INVENTION

It is an object of this invention to provide lightning protection apparatus for RF equipment coupled to an antenna which comprises a passive electrical system which will cause little, if any, interference with the operation of the RF equipment.

It is further object of this invention to provide lightning protection apparatus for RF equipment coupled to an antenna which contains no moving parts and which need not be reset or repaired after operation of the apparatus.

It is still further object of this invention to provide lightning protection apparatus for RF equipment coupled to an antenna which is not only mechanically rugged in construction but which is also relatively easy to fabricate and install.

Briefly, the lightning protection apparatus for RF equipment coupled to an antenna comprises a high pass filter serially coupled between the antenna and the RF equipment and a bandpass filter shunted across the RF equipment. The high pass filter is operative to pass frequencies which are approximately at and above the operating frequency of the RF equipment. The bandpass filter is operative to prevent frequencies which are below the operating frequency of the RF equipment from reaching the RF equipment. As will be explained hereinafter, most of the high energy frequencies which are induced in the antenna by lightning are usually below the operating frequency of the RF equipment and are therefore prevented from reaching the RF equipment. The invention provides that the bandpass filter may comprise a shorting stub having a length equal to one quarter of a wavelength of the operating frequency of the RF equipment. The high pass filter may be a capacitive reactance impedance which is formed by a cylindrical capacitor having a capacitance distributed along the length of the capacitor. If desired, lightning arrestors for personnel protection may be located at strategic points.

The nature of the invention and other objects and additional advantages thereof will be more readily understood by those skilled in the art after consideration of the following detailed description taken in conjunction with the accompanying drawings.

DESCRIPTION OF THE PREFERRED EMBODIMENT OF THE INVENTION

Figure 1:
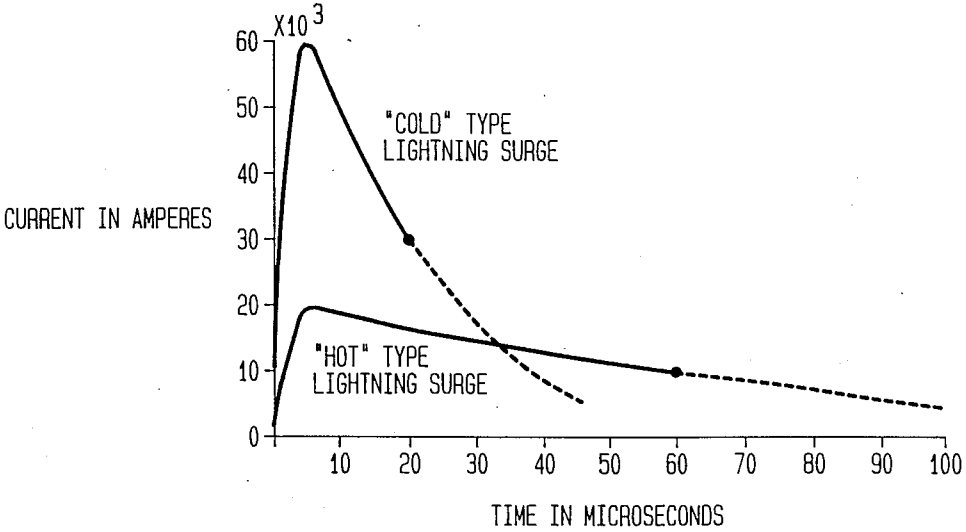
FIG. 1 is a graphical representation showing current as a function of time for both hot and cold types of lightning surges.

The graphical representation of FIG. 1 shows the current flowing in the temporarily conductive air path of a typical lightning stroke to ground. The ordinates of this representation are in thousands of amperes. If the lightning stroke itself is considered to be a half-turn primary winding of a transformer and the antenna system the half-turn secondary winding of a loose-coupled transformer, it is easily seen how a voltage may be generated in the antenna system by the lightning stroke. The induced voltage would be a function of many factors, such as the equivalent impedance between the two ends of the transformer secondary, the degree of coupling, etc. and could easily exceed thousands of volts.

It can be shown that the energy of a lightning stroke, as a function of frequency, is given by the following equation:

$$G(f) = \frac{Aetp}{(1 \pm j2\pi tpf)^2}$$

where, $A$ = peak value of current
$e = 2.71828$
$tp = 5 \times 10^{-6}$ seconds
$f$ = frequency of interest in hertz.

From the foregoing equation it is evident that the energy content is maximum at dc and rapidly falls as the frequency rises. The following Table 1 computes the energy at various dicrete frequency bands normalized to that at dc.

TABLE 1

| | Energy Distribution At Frequencies above f | | | | | | |
|---|---|---|---|---|---|---|---|
| | Calculated | | | Attn. | Per Ref/c | | |
| f | 12rtpf | Fraction | Percent | dB | MV/m | Ref to* | Approx dB |
| DC | 0 | 1.0 | 100 | 0 | | | |
| 1 kHZ | 0 | 1.0 | 100 | 0 | | | |
| 10 kHZ* | 0.3 | 0.6 | 60 | 2 | $2 \times 10^4$ | 1 | 0 |
| 100 kHZ | 3.1 | $10^{-1}$ | 10 | 10 | $2 \times 10^3$ | $10^{-1}$ | 20 |
| 1 MHZ | 31.4 | $10^{-3}$ | 0.1 | 30 | $2 \times 10^2$ | $10^{-2}$ | 40 |
| 10 MHZ | 314 | $10^{-5}$ | 0.001 | 50 | 10 | $5 \times 10^{-3}$ | 66 |
| 100 MHZ | 3.140 | $10^{-7}$ | 0.00001 | 70 | 2 | $10^{-4}$ | 80 |
| *GHz | 31.400 | $10^{-9}$ | 0.0000001 | 90 | $3 \times 10^{-1}$ | $1.5 \times 10^{-5}$ | 96 |

The foregoing table shows that for frequencies of interest in the microwave range, eliminating the energy below the frequency of interest will divert a major portion of the lightning surge energy away from the RF equipment to be protected.

Figure 2:
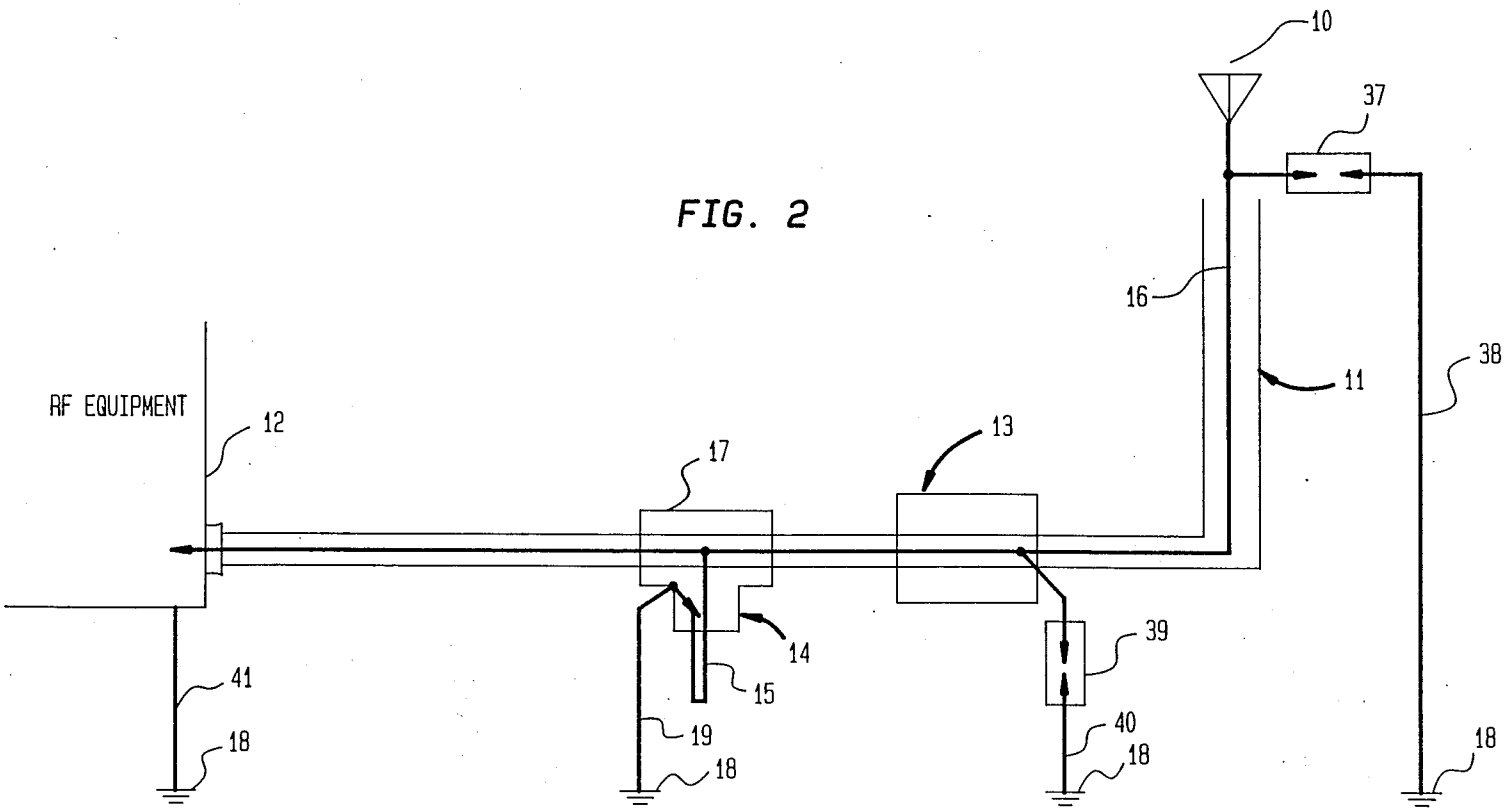
FIG. 2 is a schematic diagram of the lightning protection apparatus of the invention coupled between an antenna and an item of RF equipment.

Referring now to FIG. 2 of the drawings, there is shown lightning protection apparatus for RF equipment coupled to an antenna constructed in accordance with the teachings of the present invention. As seen therein, an antenna 10 which may be a receiving or transmitting antenna is coupled by means of a coaxial cable, indicated generally as 11, to an item of RF equipment 12 which may either provide signals to the antenna 10 for transmission or receive signals which are received by the antenna 10. Although the term "RF equipment" is used herein, it will be understood that the electronic equipment to be protected by the present invention could be any one of a number of different types of electronic equipment which operate in those regions of the frequency spectrum which utilize antennas for transmission and reception.

In accordance with the invention, a high pass filter, indicated generally as 13, is serially coupled between the antenna 10 and the RF equipment 12. This filter is oprative to pass frequencies which are approximately at and above the operating frequency of the RF equipment 12 so that it will not interfere with the reception or transmission of the traffic from/to the antenna. A bandpass filter, indicated generally as 14, is shunted across the RF equipment 12. The bandpass filter 14 is operative to prevent frequencies which are received from the antenna 10 which are below the operating frequency of the RF equipment from reaching the RF equipment. Since the high pass filter 13 is serially coupled between the antenna 10 and the RF equipment 12 and the bandpass filter 14 is arranged to shunt or be in parallel with the RF equipment 12, the series filter 13 and the shunt filter 14 in effect form a frequency responsive voltage divider with respect to signals received from the antenna and transmitted to the RF equipment. By virtue of this arrangement, the shunt bandpass filter will prevent those frequencies of the lightning surge received from the antenna 10 which are below the operating frequency of the RF equipment 10 from ever reaching that equipment. Since, as explained previously, it is this very low range of frequencies which contain the most energy which is harmful to the equipment being protected, the bandpass filter will provide good, continuous protection for the equipment.

In practice, since the antenna 10 is usually coupled to the RF equipment 12 by means of the coaxial cable 11 illustrated, the bandpass filter may conveniently comprise a shorting stub 15 which is connected to the center conductor 16 of the coaxial cable and which has an electrical length equal to one quarter of a wavelength of the operating frequency at which the RF equipment 12 operates. The bandpass filter 14 may, as illustrated, conveniently form part of a T connector having a metallic body 17 which is connected directly to earth ground 18 by means of a suitably strong ground lead 19. The ground lead should preferably be of AWG No. 6 copper braided construction. The equivalent resistance of the shorting stub would probably be on the order of 0.01 ohms. If it is assumed that the impedance of the system feeding the component is at least 50 ohms, then the Q of the shorting stub could be around 200. This will define the passband to be approximately f/200 and the rejection loss at 20 log 200, or about 46dB.

The series high pass filter portion 13 of the invention presents a problem because the greater the value of the impedance of this element, the greater is the effectiveness of the protection, however, the greater will be the loss of desirable signal to the RF equipment 12. The series element 13 is intended to enhance the performance of the protection system. It does this by increasing the ratio of the voltage divider formed by the components of the system in the frequency range that is least wanted and contains the most unwanted energy. The use of a capacitive reactance component would perform the foregoing function well because its impedance value would increase with a decrease in frequency which would greatly enhance the separation of the extraneous undesirable lightning energy from the desired signal energy from the antenna. Its value should be such that, at the desired frequency, its impedance would be of the order of 1 or 2 ohms. Thus, 1 ohm at 1 GHz would be 1,000 ohms at a MHz, 1,000,000 ohms at 1 KHz, etc. A capacitor of 200 microfarads would approximate this performance for the 1 MHz passband.

Figure 3:
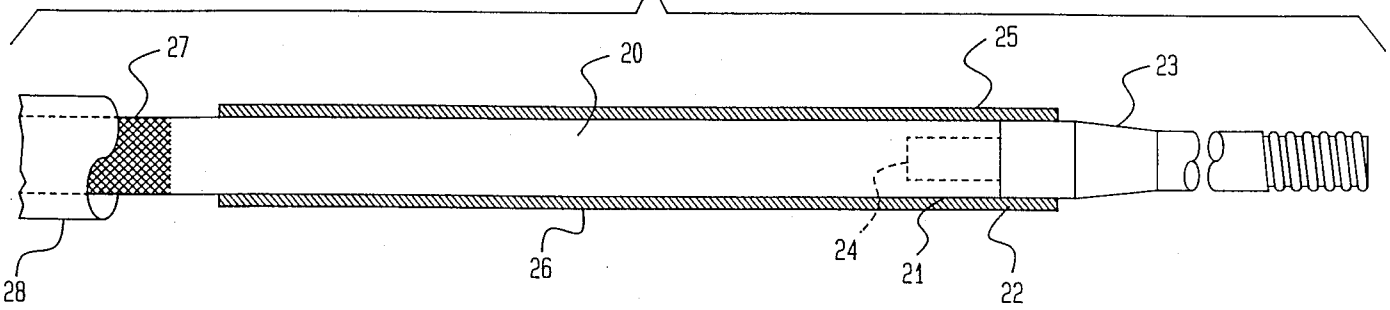
FIG. 3 is a schematic diagram of a high voltage coaxial capacitor which is suitable for use as the series high pass filter of the apparatus of the invention.

FIG. 3 of the drawings shows a high voltage coaxial capacitor which may be used for the series filter element 13 of the system of the invention. As seen therein, the capacitor comprises a cylindrical fiberglass core 20 around which is concentrically disposed a cylindrical inner conductor 21 of copper foil or other suitable conductive material. The inner conductor 21 has end 22 thereof electrically connected by means such as soldering, for example, to the metal ferrule 23 of an antenna. The end 24 of the antenna 23 is embedded in the fiberglass core 20 of the capacitor. Shrink tubing 25 is concentrically disposed about the inner conductor 21 and functions as the dielectric of the capacitor. Shrink tubing may comprise Teflon or other suitable materials which are insulators with respect to high voltage and which have a suitably high dielectric constant. A cylindrical outer conductor 26 which may also be fabricated of copper foil is concentrically disposed around the shrink tubing 25. The end 27 of the outer conductor 26 is electrically connected by means such as soldering, for example, to the braid or outer conductor of a coaxial cable or the like which is disposed in a fiberglass envelope 28.

The capacitance of this capacitor will be distributed along the length of the capacitor and will be a function of the amount by which the inner and outer conductors telescope or overlap, the thickness of the shrink tubing and the dielectric constant of the shrink tubing material. This capacitor will not only provide adequate capacitive reactance for the microwave energy being handled but will exhibit a suitably small inductive reactance so that the microwave or other signal being processed is not blocked or distorted which might be the case with conventional glass high voltage capacitors. Although antenna ferrules and the like and coaxial braid conductors have been shown as the lead elements for this capacitor it is obvious that other connectors coule be utilized.

Figure 4:
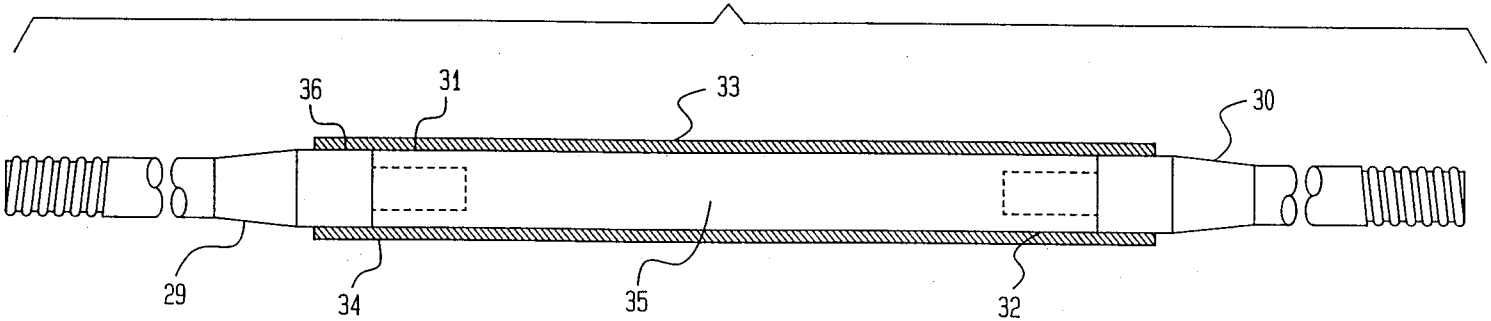
FIG. 4 is a schematic diagram of another type of high voltage coaxial capacitor which is suitable for use as the series high pass filter of the apparatus of the invention.

The capacitor shown in FIG. 4 of the drawings is an improved version of the capacitor shown in FIG. 3. In this arrangement, the two leads or connections to the capacitor are the ferrules 29 and 30 which are the same. Additionally, two capacitances are provided in series. As seen in FIG. 4, two axially-separated, cylindrical inner conductors 31 and 32 have a portion of their lengths concentrically disposed within a single, cylindrical outer conductor 33. Again, shrink tubing 34 separates the inner and outer conductors and the interior of the capacitor is the fiberglass core 35. One end 36 of each of the inner conductors 31 and 32 is electrically connected to the metal ferrule 29 or 30 with which that the inner conductor is associated. In this series capacitance arrangement of the capacitor, the net capacitance with all other dimensions unaltered would be approximately one quarter or the capacitance for the capacitor shown in FIG. 3. It may be noted that a fine, close-weave braid may be employed for the copper foil inner and outer conductors if desired.

In order to reduce the strain on the insulation in the lightning protection apparatus of the invention, it would be advisable to limit the maximum high voltage encountered at the antenna itself during a lightning stroke or surge. This may be accomplished by connecting a lightning arrestor 37 between the output of the antenna 10 and earth ground 18 by means of a lead 38. The firing time of the lightning arrestor 37 must be short. Accordingly, a gas-type, preionized discharge arrestor could be utilized. Additionally, the capacitance between the discharge points of the lightning arrestor should be low enough not to shunt any significant amount of the traffic signal energy from the antenna 10. If desired, a similar lightning arrestor 39 and a lead 40 could serve to protect the site of the series high pass filter 13 as illustrated. Finally, for personnel protection the RF equipment 12 itself should be connected to earth ground by a lead 41.

Using the data developed in Table 1 herein, the following Table 2 was developed for the apparatus of the invention:

TABLE 2

| Surge Energy in 1 GHZ System | | | | | |
|---|---|---|---|---|---|
| | Attenuations | | | Surge Energy | |
| | dB/s | dB/Sh | dB/Tot | DBR in | dBR Out |
| (1) | (2) | (3) | (4) | (5) | (6) |
| DC | | | | | |
| 1 kHz | 90 | 40 | 130 | 0 | −130 |
| 10 kHz | 70 | 40 | 110 | −0.1 | −110.1 |
| 100 kHz | 50 | 40 | 90 | −10 | −100 |
| 1 MHz | 30 | 40 | 70 | −30 | −100 |
| 10 MHz | 9.6 | 40 | 40.9 | −50 | −100 |
| 100 MHz | 0.4 | 20 | 20.4 | −70 | −90.4 |
| 1 GHz | 0.0 | 0.9 | −0.9 | −90 | −90.9 |
| 10 GHz | 0.0 | 20 | 20 | −110 | −130 |

Notes:
(2) dB/s = Attenuation due to Zs
(3) dB/Sh = Attenuation due to Shorting Stub
(4) dB/Tot = Sum of (2) and (3)
(5) dBr In = Incoming surge energy relative to peak
(6) dBR Out = Equipment surge energy relative to incoming peak The attenuation figures given in column 2 of this Table are optimistic because they assume that the capacitor will not experience any leakage throughout its life and will maintain a leakage resistance in excess of 16,000 ohms. Failure to do so however may drop the maximum attenuation to 50 db. For a 10 MHz system, the stroke energy would be reduced approximately 50 db which is a voltage reduction of about 300:1. For the 100 MHz and 1 GHz points the corresponding voltage reductions would be about 3,000:1 and 30,000:1, respectively.

It is believed apparent that many changes could be made in the construction and described uses of the foregoing lightning protection apparatus and many seemingly different embodiments of the invention could be constructed without departing from the scope thereof. Accordingly, it is intended that all matter contained in the above description or shown in the accompanying drawings shall be interpreted as illustrative and not in a limiting sense.

What is claimed is:

1. Lightning protection apparatus comprising an antenna;

RF equipment coupled to said antenna;

a high pass filter serially coupled between said antenna and said RF equipment, said filter being operative to pass frequencies which are approximately at and above the operating frequency of said RF equipment and being a coaxial cylindrical capacitor having a capacitance distributed along the length thereof; and a bandpass filter shunted across said RF equipment, said bandpass filter being operative to prevent frequencies which are below the operating frequency of said RF equipment from reaching said RF equipment and comprising a shorting stub having a length equal to one quarter of a wavelength of the operating frequency of said RF equipment.

2. Lightning protection apparatus as claimed in claim 1 wherein a first lightning arrestor is coupled between said antenna and earth ground, and a second lightning arrestor is coupled between said capacitor and earth ground.

3. Lightning protection apparatus as claimed in claim 2 wherein each of said lightning arrestors is a gas-type preionized discharge arrestor.

* * * * *